United States Patent [19]

Vacek et al.

[11] Patent Number: 5,074,344

[45] Date of Patent: Dec. 24, 1991

[54] TONER CONTAINER AND LATCHABLE COVER

[75] Inventors: Ronald R. Vacek; Kenneth D. Corby; Jeffrey C. Robertson, all of Rochester, N.Y.

[73] Assignee: Eastman Kodak Company, Rochester, N.Y.

[21] Appl. No.: 600,800

[22] Filed: Oct. 22, 1990

[51] Int. Cl.[5] ..... B65B 1/04

[52] U.S. Cl. ..... 141/363; 141/362; 141/366; 141/98; 222/DIG. 1; 355/260

[58] Field of Search ..... 141/360, 361, 362, 363, 141/364, 365, 366, 346, 351, 352, 354; 222/DIG. 1; 355/260; 220/281, 306

[56] References Cited

U.S. PATENT DOCUMENTS

| | | | |
|---|---|---|---|
| 4,060,105 | 11/1977 | Feldeisen et al. | 141/363 |
| 4,062,385 | 12/1977 | Katusha et al. | 141/364 |
| 4,862,210 | 8/1989 | Woolley | 355/260 |
| 4,997,016 | 3/1991 | Hacknauer et al. | 141/363 |

*Primary Examiner*—Henry J. Recla
*Assistant Examiner*—Robert M. Fetsuga
*Attorney, Agent, or Firm*—Leonard W. Treash, Jr.

[57] ABSTRACT

A toner container includes a containing portion and a cover. The cover is generally to be positioned adjacent a toner sump and the containing portion slid off the cover onto the sump. To prevent accidental removal of the cover when the container is not in a receiving apparatus, a releasable latch is provided for holding the cover on the container. The latch is releasable by the same motion used to position the containing portion over the sump.

5 Claims, 3 Drawing Sheets

TONER CONTAINER AND LATCHABLE COVER

TECHNICAL FIELD

This invention relates to a container for toner of the type used in copiers and printers. More specifically, it relates to toner containers of the type having covers.

BACKGROUND ART

U.S. Pat. No. 4,062,385, issued Dec. 13, 1977 to Katusha et al, shows a toner container having a containing portion with an opening on the bottom and a flange extending outward from the opening. A cover is slidably secured to the flange. A receiving apparatus for the container includes a sump cavity for receiving toner through the bottom of the container when the opening of the container is positioned directly above it. The container with the cover are positioned beside the cavity and the container portion is slid off the cover and over the cavity with the container portion flange sliding on a receiving surface that surrounds the cavity.

U.S. patent application Ser. No. 07/360,811, filed June 2, 1989, Hacknauer et al, discloses various improvements to the basic structure shown in the Katusha patent.

In the commercial embodiments of all of the above toner containers a paper cloth seal is adhesively affixed to the bottom of the flange surrounding the opening of the container to make sure that no toner escapes prior to the container being in its position over the sump. The seal itself is excellent for preventing the escape of toner as long as it maintains its integrity. However, it is important that the cover which is generally a stiff, planar sheet of plastic also cover the opening to protect the seal from being pierced by fingers or other objects. After use, the containing portion is slid back on the cover which prevents residual toner from escaping until it can be cleaned in recycling.

In the Hacknauer et al application, the cover includes protrusions from its top surface which act as a stop preventing separation of the cover and container portion by movement in a direction opposite to that movement which would take the containing portion over the sump. This stop prevents an attempt to insert the container incorrectly and also overshooting when the containing portion is moved back away from the sump onto the cover when empty.

DISCLOSURE OF THE INVENTION

The stops mentioned with respect to the Hacknauer disclosures do not prevent separation of the cover and containing portion when they are not in an apparatus by sliding the containing portion in the same direction it would go to separate from the cover when in an appropriate receiving apparatus.

It is an object of the invention to provide a container having a cover generally of the type shown in the prior art but which resists accidental separation of the cover when not in a copier or printer.

This and other objects are accomplished by the provision of a latch means restricting relative movement of the containing portion of the cover when the cover is in its covering position, which latch is releasable for separation in a receiving apparatus.

According to a preferred embodiment the latch is associated with the trailing portion of the containing portion and the cover and includes a handle which can be readily pushed by an operator to both unlatch the containing portion from the cover and push the containing portion away from the cover and over a sump.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
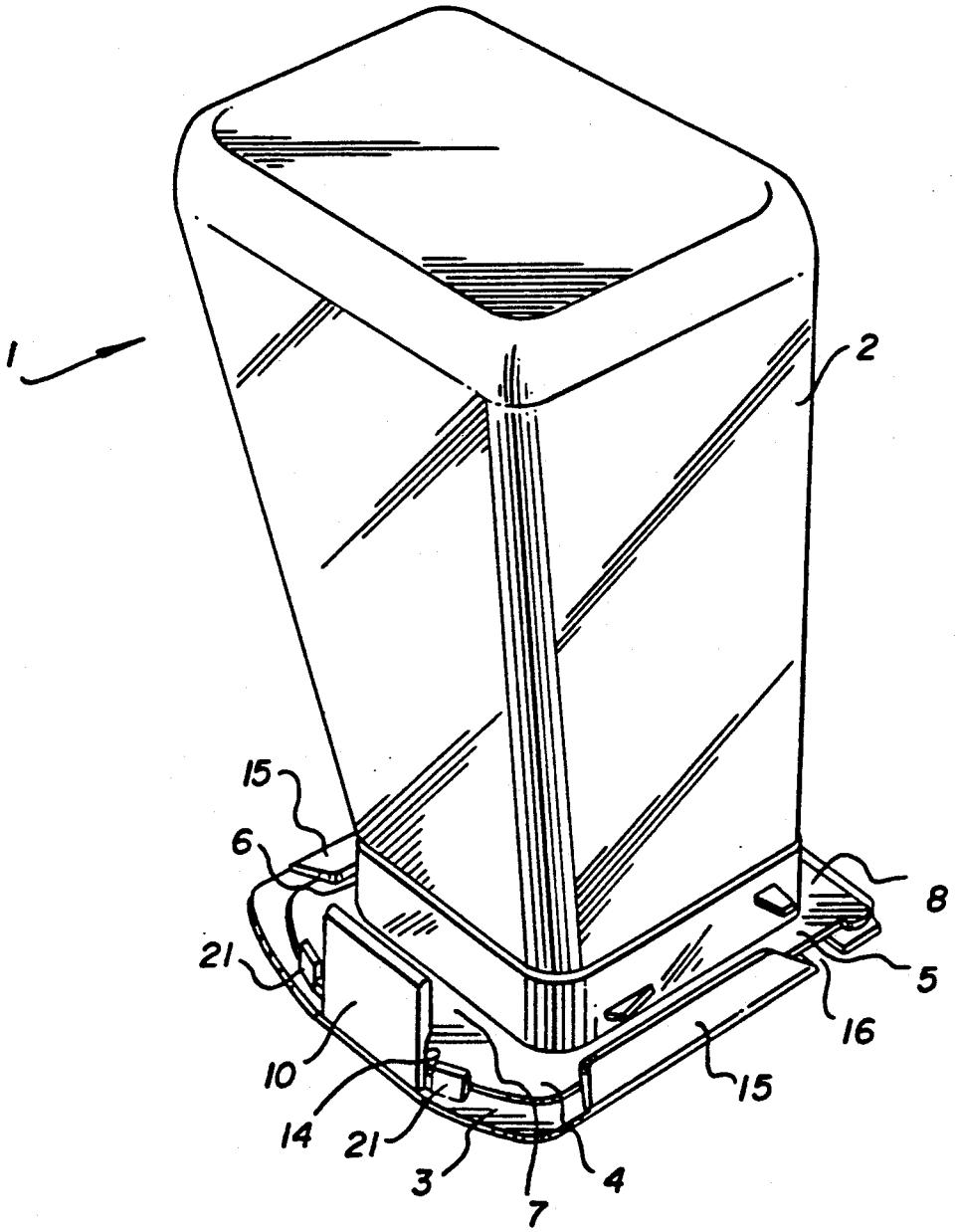
FIG. 1 is a perspective view of a toner container and its cover incorporating the invention.

Referring to FIG. 1, a toner container includes a containing portion 2 and a cover 3. The containing portion 2 is generally rectangular in cross section with a small bottom and having side walls which slant to a large top. The walls of the containing portion 2 define an opening 11 (shown in phantom in FIG. 2) through which toner held in containing portion 2 can fall when released. A flange 4 surrounds opening 11 and includes at least side portions 5 and 6 on opposite sides of opening 11 extending laterally away from opening 11. The flange also includes a trailing flange portion 7 which constitutes a trailing portion of the containing portion and a leading flange portion 8 which constitutes a leading portion of the containing portion each when moving to a position over a sump.

The cover 3 is held to flange side portions 5 and 6 by slanted guides 15 which restrict movement of the containing portion 2 with respect to the cover 3 in all directions except along a path generally parallel to guides 15. The trailing flange portion 7 also includes a handle 10 which makes up a portion of a latch to be described in more detail below. The cover 3 includes stops 21 for limiting motion of containing portion 2 in one direction, i.e., away from a position over a sump. Cover 3 also includes notches 16 which cooperate with receiving structure on the apparatus to be explained in more detail with respect to FIGS. 2–4.

Figure 4:
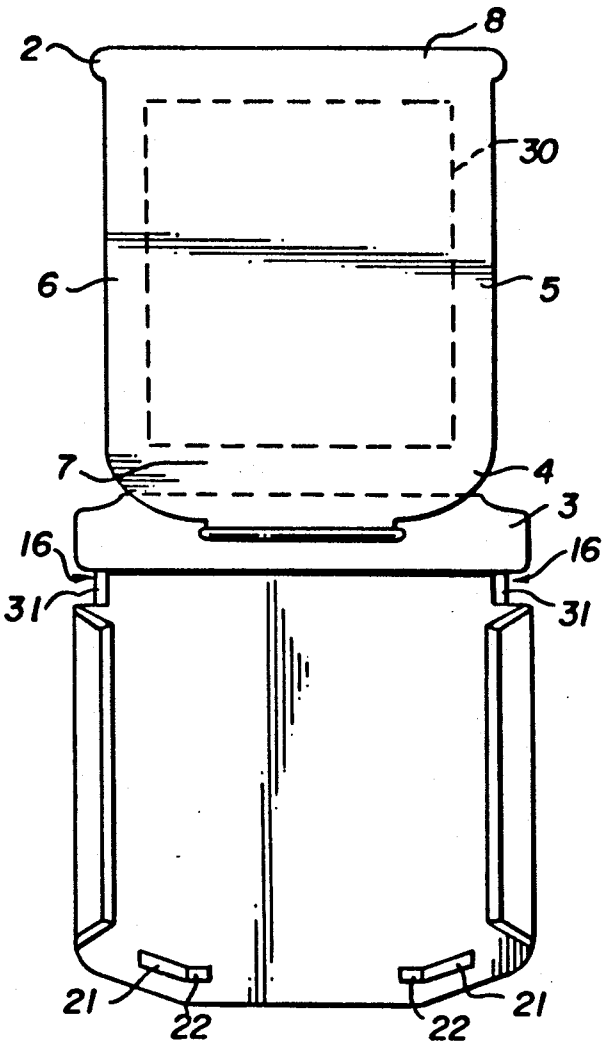
FIGS. 2, 3 and 4 are top views with portions eliminated for clarity of illustration showing three different positions for a toner containing portion with respect to a cover.
Figure 3:
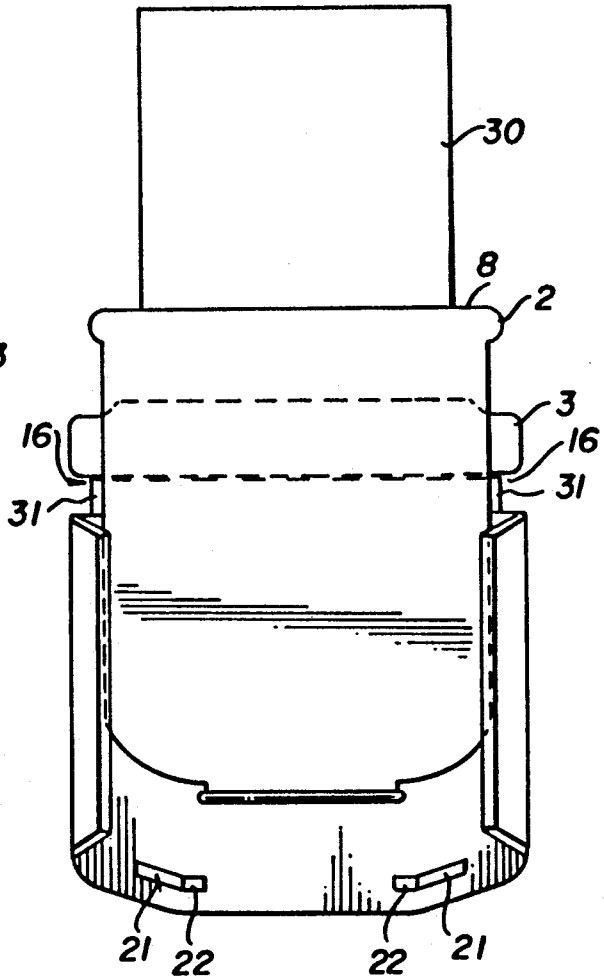
Figure 2:
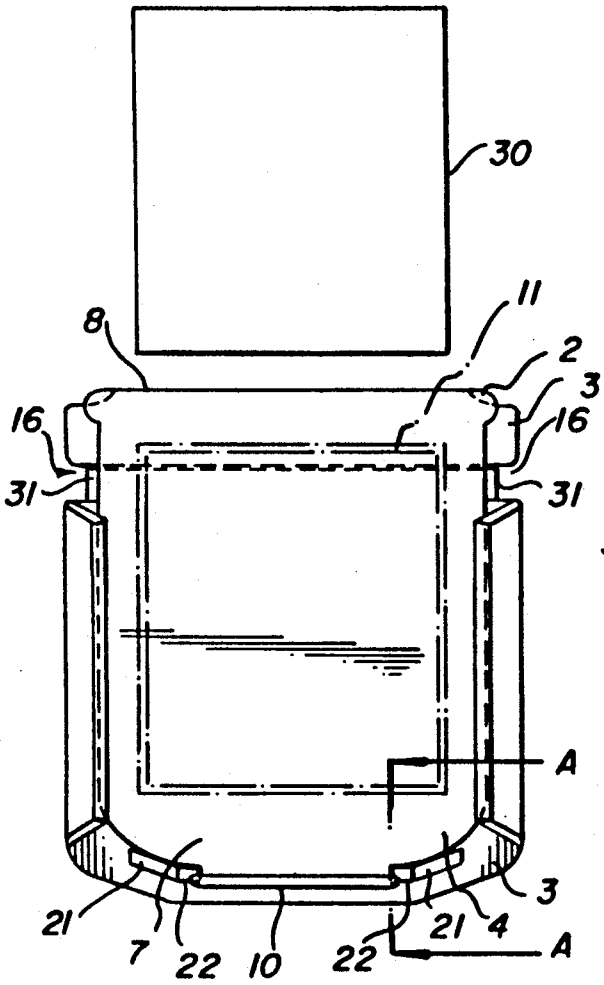

According to FIGS. 2–4 container 1 is positioned alongside a sump 30 of a receiving apparatus by positioning the notches 16 of cover 3 over protrusions 31 which are part of the receiving apparatus. Protrusions 31 restrict movement of cover 3 during positioning of the containing portion 2 over sump 30. As shown in FIGS. 2–4 the containing portion 2 is moved from its position shown in FIG. 2, through its position shown in FIG. 3 to its position shown in FIG. 4. The side flange portions 5 and 6 slide under guides 15 as the leading flange portion 8 first moves over the sump 30 as shown in FIG. 3. As the container is further pushed by the operator, it positions itself totally over sump 30 with only a portion of the trailing flange portion 7 still located on top of cover 3. Once the containing portion 2 is located over sump 30 a paper seal (not shown) secured to the bottom surface of flange 4 is removed and the contents of the containing portion 2 fall into the sump. When the toner from the containing portion 2 has entirely emptied into the sump 30, the containing portion 2 is slid back onto the cover 3 and removed from the apparatus for recycling or disposal. The stops 21 prevent the containing portion 2 from overshooting its appropriate position with respect to the cover 3 in this return movement.

The description of operation thus far is substantially as disclosed in the prior application to Hacknauer et al, referred to above. For additional details reference is made to that application which is incorporated herein by reference.

Although the stops 21 restrict motion of the containing portion 2 relative to the cover 3, both before and after location of the container on the apparatus, no structure in the prior art prevented accidental movement of the containing portion 2 with respect to the cover in the other direction. This is accomplished according to this invention by a releasable latch means associated with the trailing portion of the container.

Figure 5:
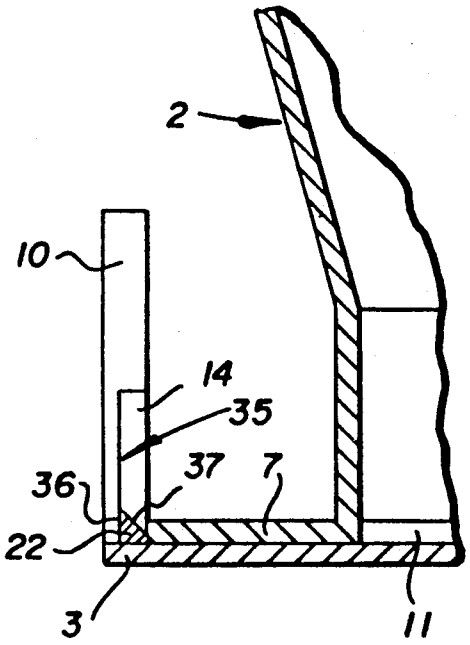
FIGS. 5, 6 and 7 are side sections taken along the line A—A shown in FIG. 2 and illustrating release of a latch holding the toner container to the cover.
Figure 6:
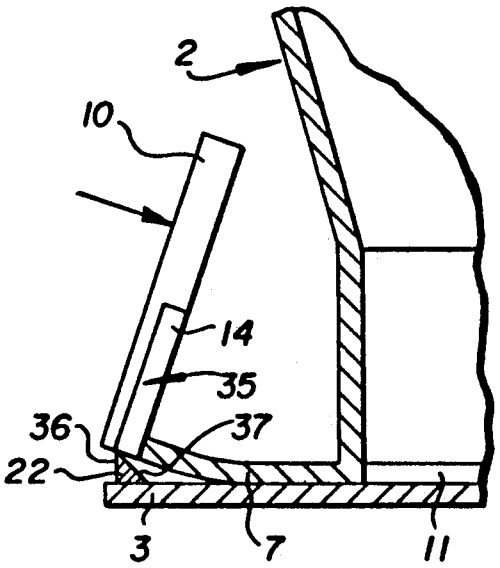
Figure 7:
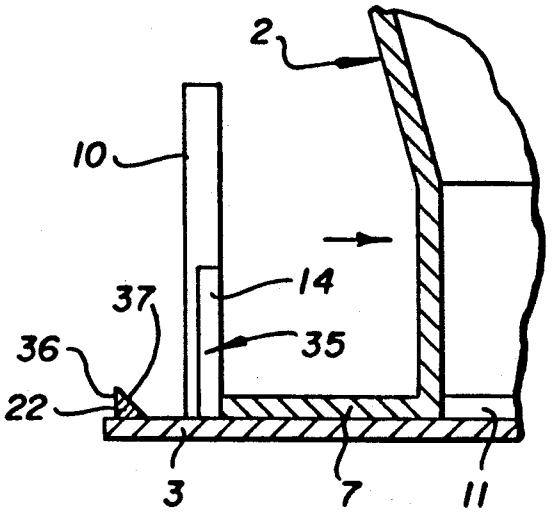

The latch means is best shown with reference to FIGS. 5–7. According to FIG. 5, cover 3 includes two ramps 22 positioned adjacent stops 21. Each ramp 22 has a latching surface 36 and a ramp surface 37. Handle 10 includes corner slots 14 which receive ramps 22. Slots 14 are partly defined by a latch surface 35 to latch the trailing edge of trailing flange portion 7 against stops 21. This position is shown in FIG. 5, in which stops 21 are eliminated for clarity of illustration. Stops 21, of course, are shown in FIGS. 1 and 2 in engagement with the trailing edge of trailing flange 7. In this condition the containing portion 2 will not accidentally release from the cover 3 in any direction.

To release the latch, handle 10 is pushed to the right by the operator as illustrated by the arrow in FIG. 6. This causes trailing flange portion 7 to bend in a generally upward direction until latch surface 35, as seen in FIG. 6, of corner slot 14 clears the top of ramp 22. At this point the latching surface 36 of ramp 22 is no longer preventing rightward movement of handle 10 and further pushing by the operator causes movement of toner containing portion 2 to the right as shown in FIG. 7. Continued pushing on handle 10 will position containing portion 2 over the sump 30.

After the container has been emptied and it is moved back onto cover 3 the left bottommost edge of handle 10 engages ramp surface 37 of ramp 22 and is moved upward to again bend trailing flange portion 7 as shown in FIG. 6. Slot 14 receives ramp 22 as handle 10 positions itself behind the latching surface 36 of ramp 22. The cover is again secure from movement with respect to the containing portion thereby assuring that residual toner left in the container will not escape to dirty the person or clothing of those handling the container.

Note that release of the latch is accomplished by the same pushing motion that will position the containing portion over the sump. Return of the containing portion automatically latches the latch.

The invention has been described in detail with particular reference to a preferred embodiment thereof, but it will be understood that variations and modifications can be effected within the spirit and scope of the invention as described herein and as defined by the appended claims.

What is claimed is:

1. A toner container comprising:

a containing portion having an opening and a flange adjacent the opening, said flange having a planar bottom surface, a generally planar cover positionable against the bottom surface of the flange to cover said opening, means for holding the cover in a position over said opening, said means permitting sliding of said cover along a path between positions covering and uncovering said opening, and releasable latch means restricting relative movement of said containing portion and said cover along said path when said cover is in its covering position, said latch means comprising a handle connected to the flange on said containing portion and protruding in a transverse direction from said flange, said flange being bendable in response to an unlatching force on said handle to move said flange away from said cover, which movement releases said latch means.

2. A toner container comprising:

a containing portion for holding toner and having a generally rectangular opening in its bottom through which toner can fall, said containing portion including a flange having a bottom surface and at least opposite side flange portions and a trailing flange portion extending laterally away from respective sides of said opening, a generally planar cover positionable against said bottom surface of said flange, said cover including means for engaging the side flange portions to hold the cover against said bottom surface in a position covering said opening, said engaging means permitting relative sliding movement of said containing portion and said cover along a path between positions in which said cover covers said opening and uncovers said opening, and releasable latch means between said trailing flange portion and said cover to prevent relative movement of said containing portion with respect to said cover along said path.

3. The container according to claim 2 wherein said latch includes ramp means integral with said cover, said ramp means having a latching surface and a ramping surface, and said latch means further including a handle connected to said trailing flange portion, which handle includes a latch surface positionable against said latching surface of said ramp means when said latch means is in a latching condition, said handle being positioned to bend said trailing flange portion in response to force applied in a predetermined direction to cause releasing of said latch by raising said handle above said latching surface.

4. The container according to claim 3 wherein said handle is positioned to engage said ramp surface during movement of said containing portion along said path in a direction covering said opening, said engagement causing raising of said handle to position said handle behind said latch surface to latch the containing portion to the cover.

5. The container according to claim 4 further including stop means on said cover for limiting movement of said containing portion with respect to said cover in a direction opposite to the direction of movement in releasing said latch means.

* * * * *